US006536925B1

(12) United States Patent
McGuire

(10) Patent No.: US 6,536,925 B1
(45) Date of Patent: Mar. 25, 2003

(54) CABLE ASSEMBLY FOR UTILITY LIGHT

(76) Inventor: John W. McGuire, 121 W. North St., #28, Waukesha, WI (US) 53188

( * ) Notice: Subject to any disclaimer, the term of this patent is extended or adjusted under 35 U.S.C. 154(b) by 0 days.

(21) Appl. No.: 10/044,115

(22) Filed: Jan. 10, 2002

(51) Int. Cl.[7] ..... F21S 8/02; F21V 21/00

(52) U.S. Cl. ..... 362/391; 362/404; 362/147; 362/250; 362/285; 362/396

(58) Field of Search ..... 362/391, 145, 362/249, 250, 147, 396, 285, 418, 404

(56) References Cited

U.S. PATENT DOCUMENTS 1,085,851 A * 2/1914 Donner ..... 362/391
3,033,978 A * 5/1962 Van Dusen, Jr. ..... 362/391
4,441,145 A * 4/1984 Antkowiak ..... 362/384
4,821,162 A * 4/1989 Ellis ..... 362/408
5,158,360 A * 10/1992 Banke ..... 362/391
5,440,469 A * 8/1995 Gomes ..... 362/226
5,455,754 A * 10/1995 Hoffner ..... 362/250
5,584,576 A * 12/1996 Wei Hong ..... 362/396
6,033,097 A * 3/2000 Harwood ..... 362/404
6,312,140 B1 11/2001 McGuire
6,318,884 B1 * 11/2001 Hibard et al. ..... 362/391

* cited by examiner

*Primary Examiner*—Thomas M. Sember
(74) *Attorney, Agent, or Firm*—Joseph S. Heino

(57) ABSTRACT

A cable assembly is used to suspend a utility light adjacent a ceiling or along a wall. The cable assembly includes a plurality of S-hooks for supporting and allowing smooth movement of the utility light along the cable. Attached to one of the S-hooks is a plastic drag chain for manually adjusting the placement of the light at all points along the cable. It also provides for an extendable and retractable utility light suspended from that S-hook. Use of this configuration allows the utility light to be used at all points along the cable and in the surrounding areas adjacent to it.

10 Claims, 1 Drawing Sheet

CABLE ASSEMBLY FOR UTILITY LIGHT

FIELD OF THE INVENTION

This invention relates generally to lights and light fixtures. More specifically, it relates to a cable and a cable assembly that is used in conjunction with a retractable utility light that allows for slidable movement of the retractable utility light along the track assembly and which allows for a greater area of usage for the retractable utility light.

BACKGROUND OF THE INVENTION

The use of light fixtures and retractable light fixtures is well known. These fixtures provide illumination in nearly any place and under nearly any condition as long as an electrical source is nearby to supply energy.

In the experience of this inventor, two spaces long ignored by the light fixture industry are workshop and storage areas. Frequently, portable light sources are required. Unfortunately, portable light sources require batteries, which are expensive to replace, bothersome to recharge, or fail to put out the necessary quantity of light. This inventor is also cognizant that many people who take advantage of utility lights frequently need both hands to perform the task they had planned.

This inventor is also aware that people will not purchase an extremely costly item to light their work or storage areas, nor will they install expensive lighting systems. In view of that recognition, this inventor previously devised a track and trolley assembly that is surface mounted to a ceiling and extends longitudinally in front of a number of adjacent apartment or condominium compartment storage areas. An example of that assembly is described and illustrated in the McGuire U.S. Pat. No. 6,312,140. Though that assembly improves over prior art in that it provides a new, useful and uncomplicated device that allows a single electrical outlet to be utilized with a retractable utility light, the track assembly itself is somewhat more complex in construction than such as may be desired by a user of the assembly.

Therefore, this inventor has provided a new, useful and an even less complicated device that allows a single electrical outlet to be utilized with a retractable utility light for illuminating a living or storage space as desired or required. This innovative approach to portable, economic utility lights generally comprises a length of cable, a pair of surface mountable cable clamps, an electrical extension cord, a plurality of electrically insulated "S-hooks" with a portion of the cable inserted through one loop of the "S" and the other loop of the "S" accommodating a portion of the electrical extension cord, another "S-hook" supporting a chain, with the chain supporting an extendable and retractable utility light, a plurality of support brackets, and a plastic drag chain attached to the S-hook supporting the light.

SUMMARY OF THE INVENTION

Accordingly, it is an object of the present invention to provide a new, useful and uncomplicated device for moving a portable utility. It is another object of this device to provide for a sliding or slidable mobile utility light, the light being slidable along a suspended cable. It is a further object to provide for a utility light assembly that allows the light to be retractable for providing light at various levels and at various distances from the cable for greater illumination. It is also an object of this invention to provide such a device that utilizes a minimal number of elements and that requires few steps to utilize. It is yet another object of the present invention to provide a device that is quickly and readily usable with existing electrical outlets. It is still another object to provide such a device that also electrically isolates the utility light from the cable that it is suspended from.

The present invention has obtained these objects. As previously alluded to, it provides for a cable assembly that is used to suspend a utility light adjacent to a ceiling or along a wall. The cable assembly includes a simplified trolley for supporting and allowing smooth movement of the utility light along the cable. Attached to this simplified trolley is a plastic drag chain for manually adjusting the placement of the light along the cable. It also provides for an extendable and retractable utility light. Use of this configuration allows the utility light to be used at all points along the cable and the areas adjacent to it. The foregoing and other features of the device of the present invention will be further apparent from the detailed description that follows.

DETAILED DESCRIPTION

Figure 1:
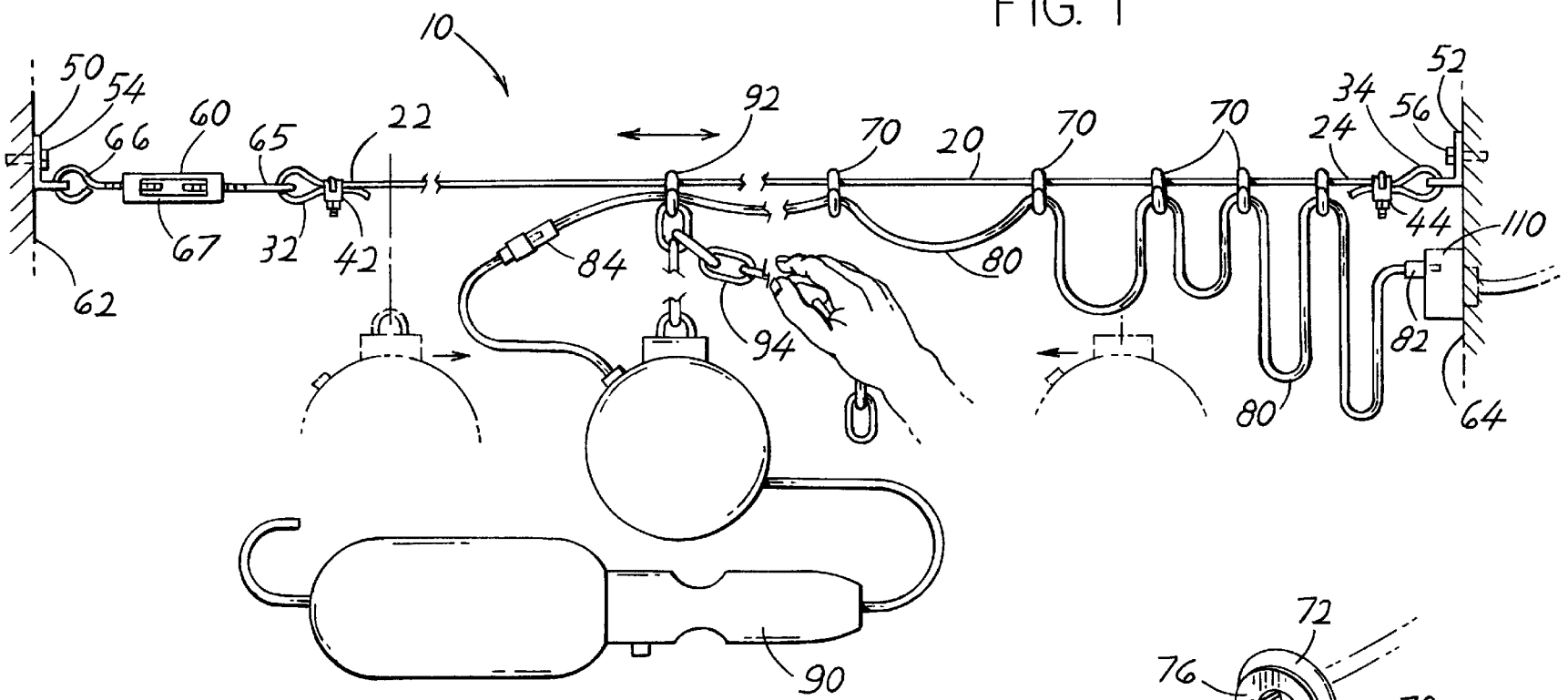
FIG. 1 is a front elevational view of an assembly constructed in accordance with the present invention and showing the elevated cable assembly and light suspended between two walls.

Referring now to the drawings in detail, wherein like numbered figures refer to like numbered elements throughout, FIG. 1 shows a preferred embodiment of the device of the present invention. The device includes a cable assembly, generally identified 10. The cable assembly 10 includes a longitudinally extending cable 20. The cable 20 includes a first cable end 22 and a second cable end 24. The first cable end 22 is folded over to form a first cable end loop 32. The second cable end 24 is likewise folded over to form a second cable end loop 34. The loops 32, 34 of the cable ends 22, 24 are secured in that shape by means of a cable clamp 42, 44, respectively, situated at each end of the cable 20. Other methods and means of cable securement are well known to the inventor and the configuration illustrated by this detailed description is meant only for illumination and not for limitation.

Located generally at the first end 22 of the longitudinally extending cable 20 is a first ninety-degree bracket 50. Also shown at this end 22 of the cable 20 is a turnbuckle 60, the purpose of which will be explained later. At the second end 24 of the cable 20 is a second ninety-degree bracket 52, although it is to be understood that many other types of wall bracket could be employed. As shown, a portion of the second cable loop 34 passes through an aperture or hole (not shown) that is defined within one leg of the bracket 52. The significance of the use of the ninety-degree brackets 50, 52 is that each can be attached to either a horizontal surface such as a ceiling (not shown) or to a vertical surface such as a wall 62, 64, respectively by means of a fastener 54, 56. Both attachment means allow for the spacing of the extended cable 20 away from other adjacent surfaces, such as a ceiling or a wall, for example.

As shown in FIG. 1, the first end 22 of the cable 20 is attached to a first eyelet end 65 of the turnbuckle 60. The second eyelet end 66 of the turnbuckle 60 is attached to the first ninety-degree bracket 50. As shown, a portion of the second eyelet end 66 of the turnbuckle 60 passes through an aperture or hole (not shown) that is defined within one leg of the bracket 50. It is to be understood that the turnbuckle 60 can be a standard over-the-counter turnbuckle designed to permit rotation of the first and second eyelet ends 65, 66 within a central turnbuckle body 67. In this fashion, the tension of the cable 20 can be adjusted by rotation of the turnbuckle body 67 such that the cable 20 assumes an as nearly linear position as possible as it hangs between the brackets 50, 52. Although not shown, it would also be possible to utilize a second turnbuckle 60 at the opposite end of the cable 20.

It is also to be understood that the cable 20 of the device of the present invention can be one of several different types that are readily and commercially available. Ordinarily, and as illustrated in FIG. 1, a standard steel cable having a diameter of approximately ⅛ inch to ¼ inch could be used, although both larger and smaller cables would be acceptable. An alternative embodiment of the device of the present invention employs a cable 20 of nonconductive material similar to steel in both strength and stiffness. Yet another embodiment of the device of the present invention employs a cable 20 that is coated with a nonconductive material (not shown). The cable 20 of the present invention is not of any specific length, rather, if sold as a package, should come in such a length that the end user can customize the length of the cable 20 to the size of the room in which the assembly is to be installed as such is desired or required.

Figure 2:
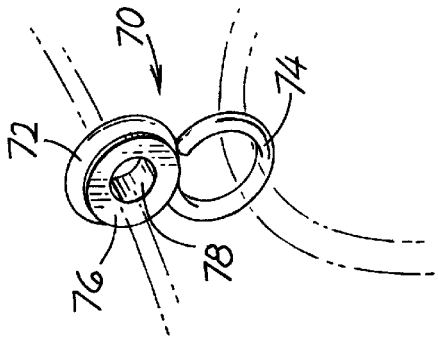
FIG. 2 is an enlarged left side, front and top perspective view of an electrically insulated S-hook utilized in the assembly shown in FIG. 1.

The device of the present invention further includes a plurality of S-shaped hooks or "S-hooks" 70. The number of S-hooks 70 to be used in the assembly 10 is determined, in part, by the overall length of the cable 20, each S-hook 70 being movable along that length of the cable 20 that extends between the clamps 42, 44. As shown in FIG. 1, the plurality of S-hooks 70 are used to suspend an electrical extension cord 80 along the cable 20. Each S-hook 70 can be a standard S-hook such as one might find used, for example, in a shower curtain apparatus. However, the preferred embodiment of each S-hook 70 is as shown in FIG. 2. As shown, the upper portion 72 of each S-hook 70 features an insert 76 that is not electrically conductive. The S-hook insert 76 includes a central aperture 78 for receiving a portion of the cable 20 (shown in phantom view) through it. This nonconductive insert 76 prevents the possibility of a short circuit to the cable 20, thereby preventing any shock hazard by virtue of an energized cable 20 or any part of the assembly 10 connected to the cable 20. Obviously, if as described above, the cable 20 is insulated, the S-hook 70 need not be insulated. The upper portion 72 of each S-hook 70 also functions as a trolley, thereby permitting movement along the cable 20. The bottom portion 74 of each S-hook 70 accommodates a portion of the electrical extension cord 80 (also shown in phantom view).

The electrical extension cord 80 includes a male end 82 and a female end 84. The male end 82 of the cord 80 is attached to a standard electrical outlet 110 located in the wall 64 and provides electrical energy to the utility light 90, the utility light 90 being connected to the female end 84 of the cord 80. In the preferred embodiment, the utility light 90 is suspended from yet another S-hook 92. This utility light supporting S-hook 92 partially or completely encircles the cable 20. And the utility light supporting S-hook 92 also provides an attachment point for a plastic drag chain 94. The plastic drag chain 94 is used to pull the utility light supporting S-hook 92 and the utility light 90 along the length of the cable 20. The plastic drag chain 94 should be of a length that it is long enough for a person to reach to move the utility light 90 along the cable 20.

From the foregoing detailed description of the illustrative embodiment of the invention set forth herein, it will be apparent that there has been provided a new, useful and uncomplicated device that provides an apparatus for moving a portable utility light over a large area and requires only a minimal number of elements to utilize.

The principles of this invention having been fully explained in connection with the foregoing, I hereby claim as my invention:

1. A cable assembly for use with a utility light comprising a pair of wall brackets, a length of cable stretched between the wall brackets, a pair of cable clamps employed to attach each end of the cable unto itself and create a loop at each end of the cable, an electrical extension cord, a plurality of S-hooks, each S-hook having a top loop portion for suspending the S-hook from a portion of the cable and a bottom loop portion for suspending a portion of the electric extension cord, an electrical utility light suspended from one of said S-hooks, and a drag chain suspended from the same S-hook as the utility light.

2. The cable assembly of claim 1 wherein a turnbuckle is interposed between the wall bracket and the cable.

3. The cable assembly of claim 2 wherein the top loop portion of each S-hook is insulated with a material that is not electrically conductive.

4. The cable assembly of claim 2 wherein the cable is not electrically conductive.

5. The cable assembly of claim 2 wherein the cable is coated with a material that is not electrically conductive.

6. A cable assembly for use with an electrical utility light comprising, a length of cable with a first end and a second end, a pair of cable clamps, a pair of wall brackets with the cable stretched between the wall brackets, a first loop formed at the first end of the cable with one of the cable clamps securing the first end of the cable back on to the cable and with the loop attached to one of the wall brackets, a second loop formed at the second end of the cable with one of the cable clamps securing the second end of the cable back on to the cable and with the loop attached to one of the wall brackets, an electric extension cord, a plurality of S-hooks each having an upper portion suspended on the cable and a lower portion suspending the electric extension cord, an electrical utility light suspended from one of the S-hooks, and a drag chain suspended from the same S-hook as the utility light.

7. The cable assembly of claim 6 wherein a turnbuckle is interposed between the wall bracket and the cable.

8. The cable assembly of claim 7 wherein the top loop portion of each S-hook is insulated with a material that is not electrically conductive.

9. The cable assembly of claim 7 wherein the cable is not electrically conductive.

10. The cable assembly of claim 7 wherein the cable is coated with a material that is not electrically conductive.

* * * * *